US011639674B2

(12) United States Patent
Kelly et al.

(10) Patent No.: US 11,639,674 B2
(45) **Date of Patent: *May 2, 2023**

(54) OIL FILTER ASSEMBLY

(71) Applicant: RB Distribution, Inc., Colmar, PA (US)

(72) Inventors: Andrew Setz Kelly, Philadelphia, PA (US); Evan Soda, Perkiomenville, PA (US); Gabriel Kovacs, Abington, PA (US); Robert Pisch, Willow Grove, PA (US); Eric Tryson, Willow Grove, PA (US)

(73) Assignee: RB Distribution, Inc., Colmar, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/528,884

(22) Filed: Nov. 17, 2021

(65) Prior Publication Data

US 2022/0074327 A1 Mar. 10, 2022

Related U.S. Application Data

(63) Continuation of application No. 17/406,639, filed on Aug. 19, 2021.

(60) Provisional application No. 63/068,759, filed on Aug. 21, 2020.

(51) Int. Cl.
*F01M 11/03* (2006.01)

(52) U.S. Cl.
CPC ..... *F01M 11/03* (2013.01); *F01M 2011/033* (2013.01)

(58) Field of Classification Search
CPC ..... F01M 11/03; F01M 2011/033
USPC ..... 123/196 A
See application file for complete search history.

(56) References Cited

U.S. PATENT DOCUMENTS

| | | | | |
|---|---|---|---|---|
| 5,090,376 | A * | 2/1992 | Bedi | F01M 11/0458 123/196 R |
| 5,351,664 | A | 10/1994 | Rotter et al. | |
| 10,195,553 | B2 * | 2/2019 | Baxter | F01M 11/03 |
| 11,339,692 | B2 * | 5/2022 | Girondi | F28D 9/005 |
| 2006/0219208 | A1 | 10/2006 | Chonan et al. | |
| 2007/0175434 | A1 * | 8/2007 | Gruner | B01D 35/18 123/196 AB |
| 2010/0000708 | A1 * | 1/2010 | Kiemlen | F01M 5/002 165/104.19 |
| 2014/0131129 | A1 * | 5/2014 | Galsworthy | F02M 35/10013 180/219 |
| 2016/0318569 | A1 | 11/2016 | Zellmer et al. | |
| 2019/0023322 | A1 * | 1/2019 | Haselhorst | B62D 21/11 |

OTHER PUBLICATIONS

Oil Filter Adapter Housing Assembly 68105583AF 68105583AE Fits for 2014-2018 Chrys-ler 300 Town Country Dodge Challenger Charger Grand Cherokee Ram ProMaster 1500 3.6 V6 Oil Cooler Kit (Year: 2019).*

(Continued)

*Primary Examiner* — Yi-Kai Wang
(74) *Attorney, Agent, or Firm* — Volpe Koenig

(57) ABSTRACT

A one-piece cast metallic adaptor for a filtering assembly that provides for direct threading of associated components to the adaptor. The adaptor provides an enclosed flow path for lubricant to flow between an engine lubrication network and a filter housing.

6 Claims, 4 Drawing Sheets

(56) References Cited

OTHER PUBLICATIONS

Website: https://www.amazon.com, "Engine Oil Cooler and Filter Housing Adapter Kit 68105583AF 68105583AE Replacement for Chrysler Dodge 3.6L V6 Vehicles 200 Town & Country Grand Caravan Wrangler Ram" at least as early as Jan. 1, 2020.
Chinese Office Action dated Dec. 21, 2022 for Chinese Patent Application No. 202110968161.X. English Translation attached.

* cited by examiner

OIL FILTER ASSEMBLY

CROSS REFERENCE TO RELATED APPLICATION

This application is a Continuation of U.S. Non-Provisional application Ser. No. 17/406,639, filed on Aug. 19, 2021, which claims the benefit of U.S. Provisional Application No. 63/068,759, filed on Aug. 21, 2020, which are incorporated herein by reference as if fully set forth.

FIELD OF INVENTION

The invention relates generally to the lubrication of mechanical engines that utilize oil as a lubricating fluid that circulates though defined galleries in the engine. More particularly, the invention relates to a lubrication system where the lubricating fluid is routinely passed through a filter element, which is generally replaceable at certain intervals, and potentially and oil cooler. Most particularly, the invention relates to an adaptor for a lubrication system that incorporates the oil filter housing and an oil cooler in an assembly that is often located within the motor valley.

BACKGROUND

Modern engines, especially though used in motor vehicles, seek to reduce weight and size while maintaining the desired power. As part of the effort to reduce weight, many parts are being made in plastic and many parts are being combined in assemblies to further reduce weight by eliminating individual connection points. While this trend has proven successful in some areas, it has introduced problems where one or more portions of a plastic assembly experience a failure. Under these conditions, it is often necessary to disassemble unrelated parts of the engine in order to gain access to the assembly and make the necessary repairs.

Another drawback to plastic assemblies is the need to made accommodations for various sensors and system components that need to be connected to the assembly. These connections are most often achieved by molding an opening in the plastic component and attaching a metallic insert to achieve the connection. This plastic to metal connection can be difficult to properly seal. An addition failure point of this metal-plastic connector is the possibility of over tightening the inserted component, such as a sensor fitting or cap, and stressing or damaging the surrounding plastic.

In addition to the above associated with a hybrid plastic-metallic assembly, the molding process requires certain concessions in order to permit molding cores to be inserted and removed during the molding process. An associated drawback with the plastic molding is the need to remove core elements used in the process and reseal the molding which leads to further potential failure points. In addition, the unused molded openings that require closing plugs that must be glued or welded in the unused openings. These plugs represent another failure point in the plastic-metallic assembly.

SUMMARY

The applicants have discovered that a cast metallic part provides a robust assembly that avoids the needs for inserts, eliminates the need for plugs, and provides for direct threading of components to the adaptor. As a result of eliminating the assembly of multiple molded parts, the performance and durability is improved against burst pressure, heat and age degradation, and conditions related to cycling. In addition, the single metallic casting provides a flow path without the need for adhesives and resealing of the flow path.

DETAILED DESCRIPTION OF THE PREFERRED EMBODIMENT

Figure 1:
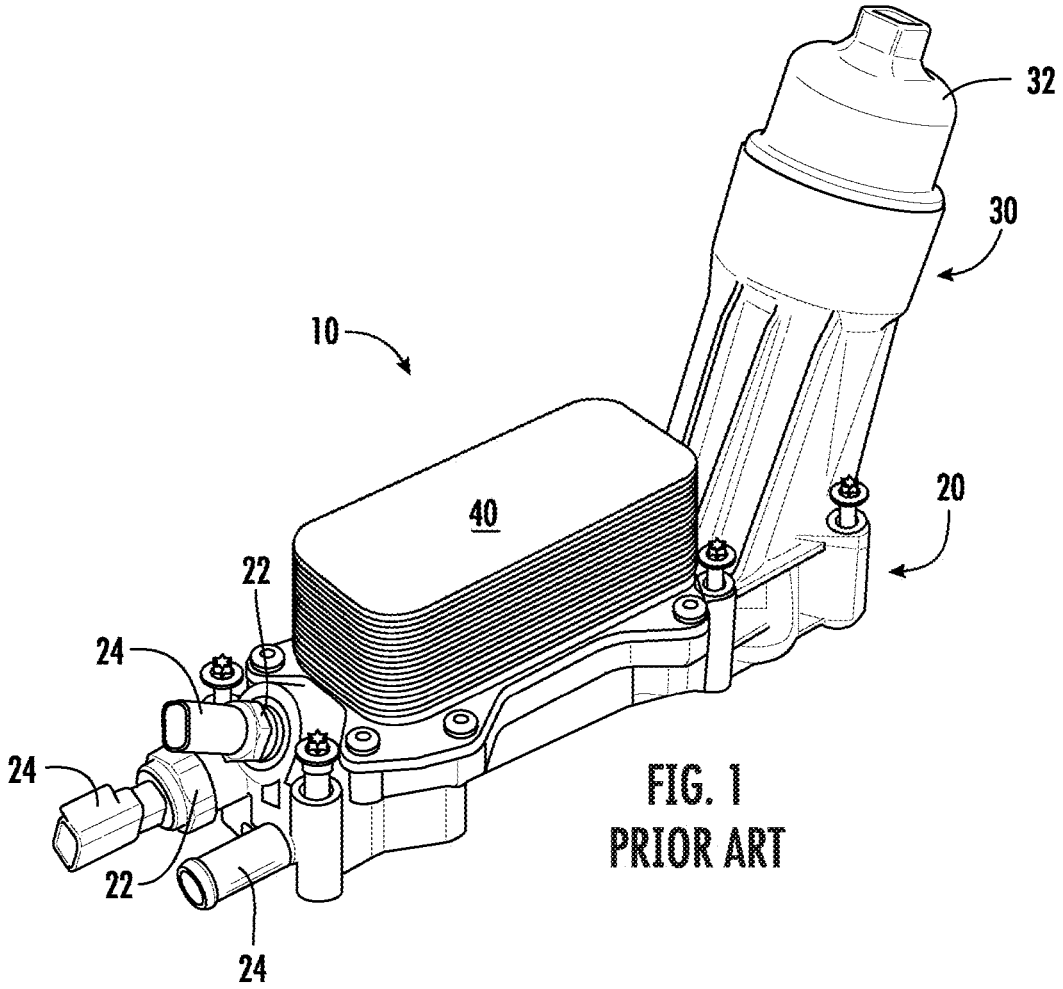
FIG. 1 PRIOR ART
FIG. 1 is a perspective view of a prior art oil filter adaptor and cooler assembly.

The prior art oil filter assembly shown in FIGS. 1-3B is typical of the adaptor construction resulting from using moldable plastic materials. The prior art assembly 10 in FIG. 1 has a base 20, a filter housing 30 and an oil cooler 40. The base 20 includes medal inserts 22 that are provided in the plastic construction at designated locations for the attachment of other associated components. The metal inserts and associated components are shown in FIG. 1 at 22 and 24 respectively. Although the metal inserts are frequently molded in situ during the molding of the plastic base, they remain a failure point and can result in oil leakage or worse. The metal inserts 22 are also subject to overtightening during attachment of the associated components 24, which can result in stress cracks in the plastic.

Figure 2:
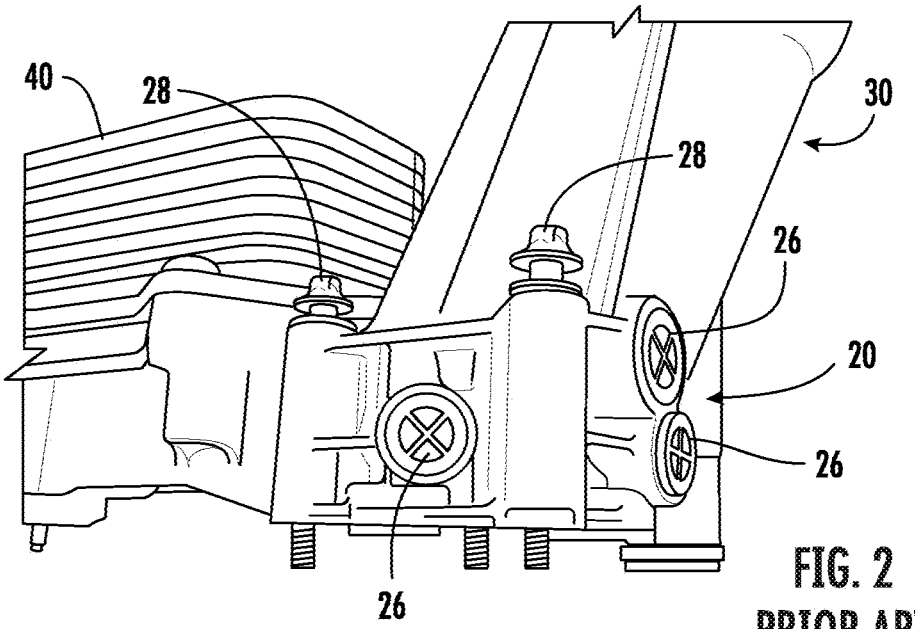
FIG. 2 PRIOR ART
FIG. 2 is a partial rear view of the prior art assembly in FIG. 1.

As shown in FIG. 2, the base 20, due to the molding process requiring the ability to withdrawal a core, has a number of plugs 26 that are retrofitted after the base 20 is molded. The plugs 26 are assembled to the molded base with an adhesive or spin welding. In either event, the plugs 26 are a failure point in the base 20 that can result in oil leaking or worse.

In addition to the inserts 22 and plugs 26, the base 20 has a number of metal inserts or sleeves, not shown, that are inserted to reinforce the plastic molded apertures for attachment of the various bolts 28 that hold the assembly 10 together. Here again, the inserts or sleeves introduce a potential failure point. Another potential failure point is the attachment of the cap 32 to the plastic filter housing 30. Over tightening of the cap 32 can introduce stress fracture in the threaded housing 30.

Figure 3A:
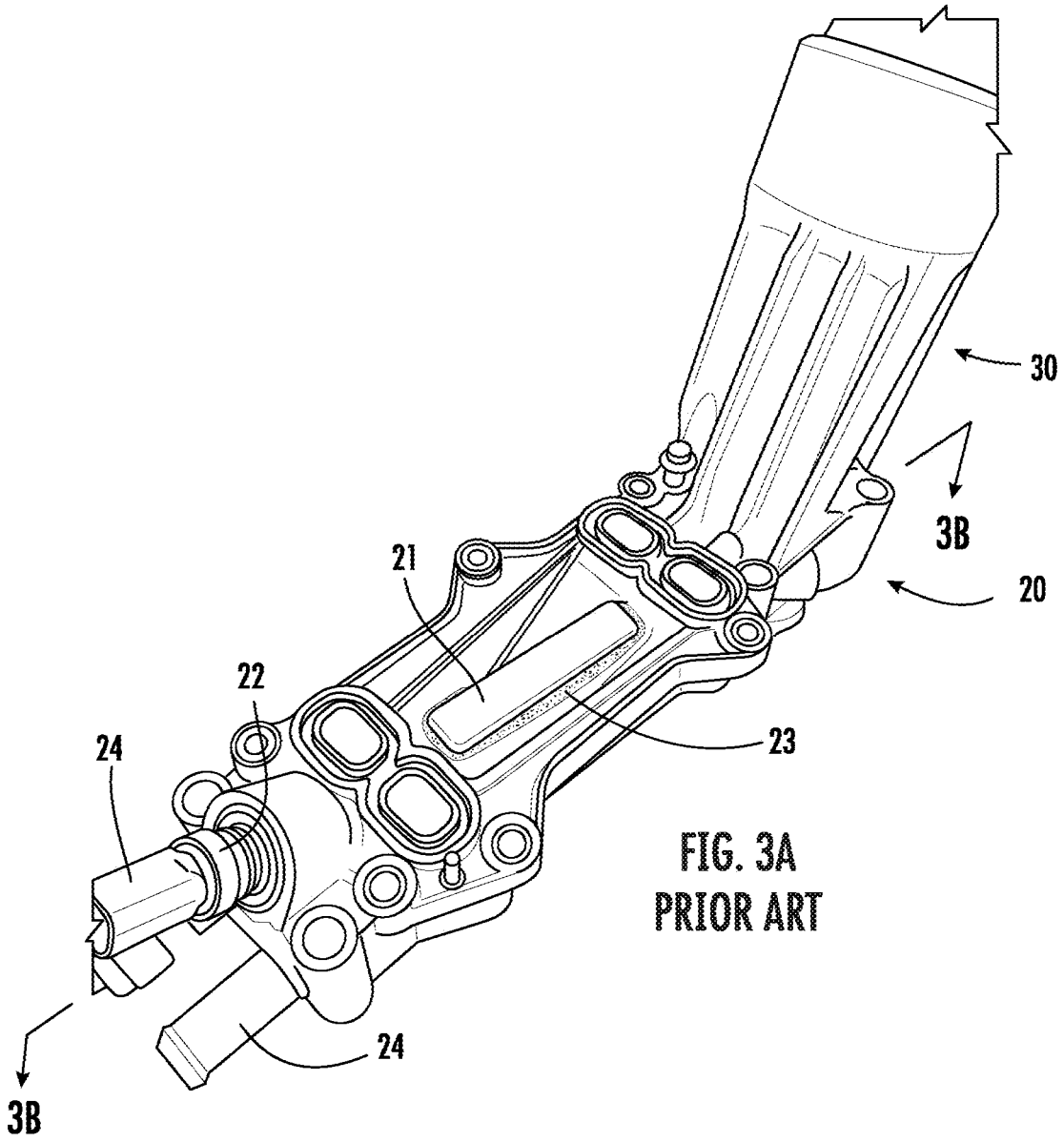
FIG. 3A PRIOR ART
FIG. 3A illustrates the capping of the oil flow path in the prior art adaptor after removal of the core used in the plastic molding.
Figure 3B:
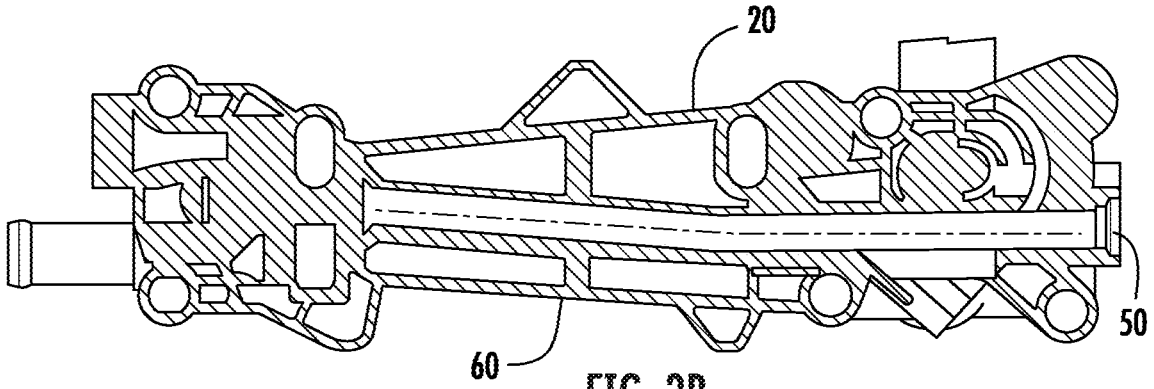
FIG. 3B PRIOR ART
FIG. 3B is a section illustrating the flow path in the prior art adaptor.

With reference to FIGS. 3A and 3B, it can be seen that the prior art flow path 50 requires a cover 21, at least partially over the flow path, that is adhered to the base after the molding core is removed by the adhesive or welding 23. With reference to FIG. 4B, it can be seen that the flow path 50 bends or is angular; in other word, the flow path 50 does not have a common longitudinal axis.

Figure 4:
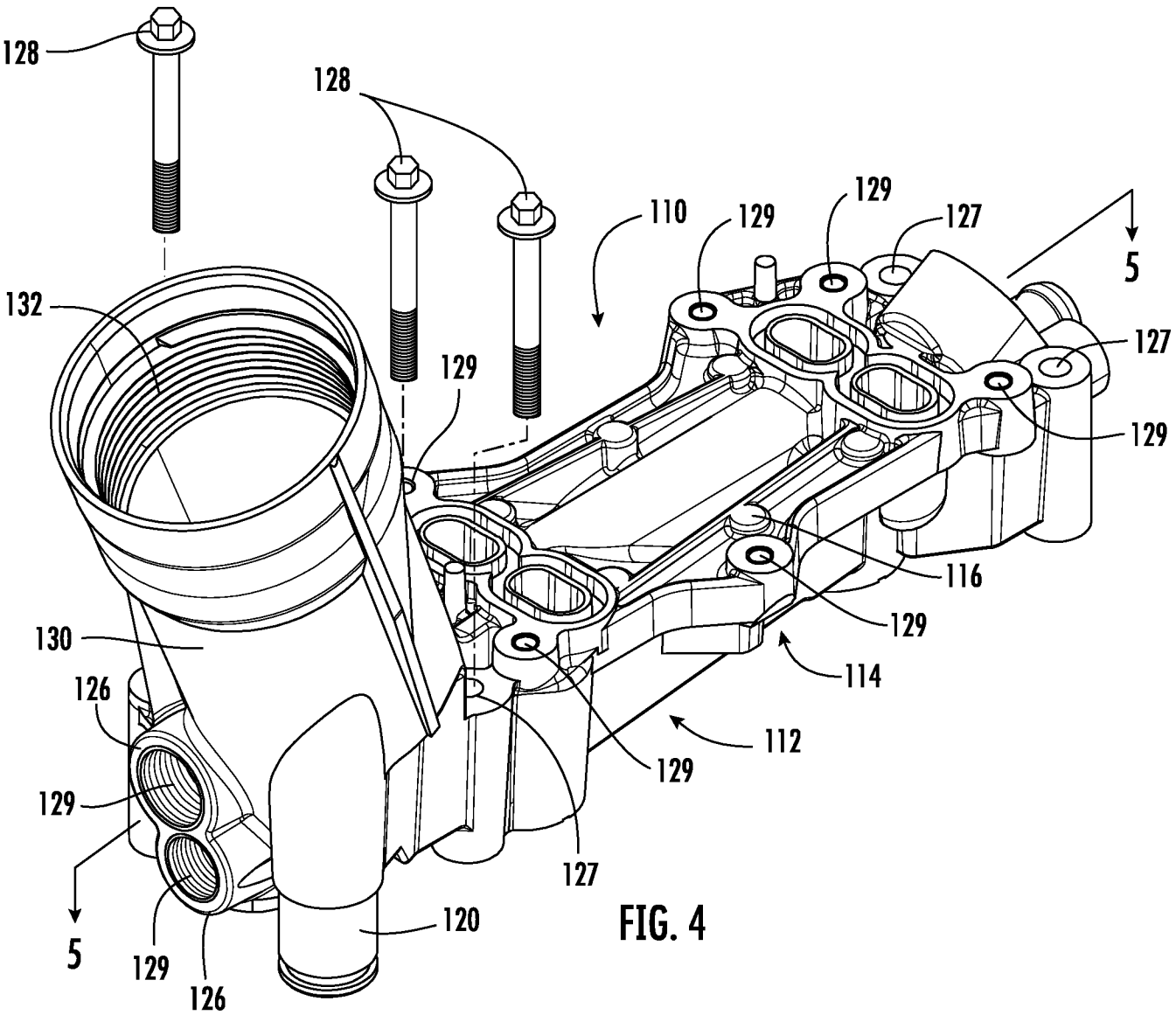
FIG. 4 is a perspective view of an adaptor according to the invention prior to assembly of any related components.

With reference to FIG. 4, the preferred adaptor 110 has an elongated body 112, which has a lower surface 114 that mates with a lubrication network and an upper surface 116 that mates with a cooling component, a filter housing 130 and base 120 that is formed of a casted metallic material, preferably aluminum. The base 120 and the filter housing 130 are casted together and the apertures 127 for receiving the bolts 128 do not required metal inserts or sleeves to avoid stressing or cracking do to the solid metallic construction. The casting is also threaded at 129 to receive fasteners for securing an oil cooler 40 and external connnectors to the adaptor 110.

Still with reference to FIG. 4, the casted filter housing 130 has internal threaded 132 that mate with an OEM cap 32 to secure a filter within housing 130. In a similar manner, the apertures 126 have internal threading to preferably mate with NPT plugs that are self-sealing. Depending on the type and construction of related components, such as sensors, it may be necessary to employ a gasket or sealing rings with their assembly.

Figure 5:
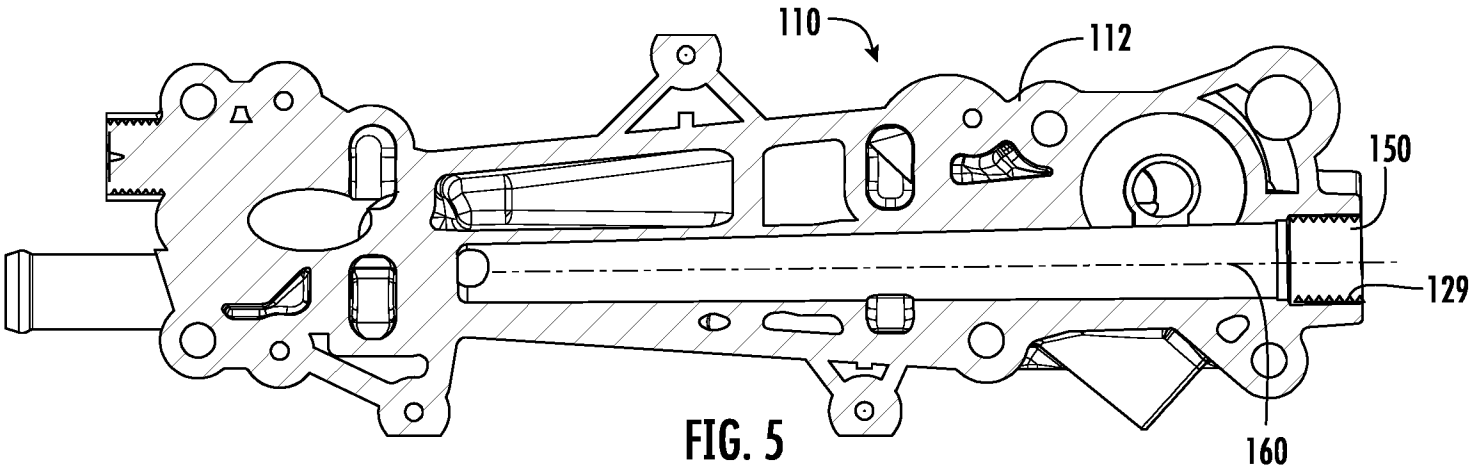
FIG. 5 is a section view along the line 5-5 in FIG. 4 showing the linear flow path in an adaptor according to the invention; and, FIG. 6 is a perspective view of an adaptor according to the invention in a direction opposite to that of FIG. 4.

With reference to FIG. 5, the flow path 150 for transporting the lubricant within base 120 to connect with the internal lubrication network is centered about the longitudinal axis 160 and consistent throughout the base 120. The flow path 150 is symmetric about the axis 160 and there is no angular component in the flow path 150 as it is connected with the internal lubrication network. The flow path 150 is entirely within the unitary casting so there is no need for adding a closure to the flow path.

With the exception of the flow path 150, the lubrication galleries and the location positions for associated components are identical to the OEM assembly so the casted metal adaptor is a direct replacement for the OEM part and no modifications or relocations of other components are necessary.

Figure 6:
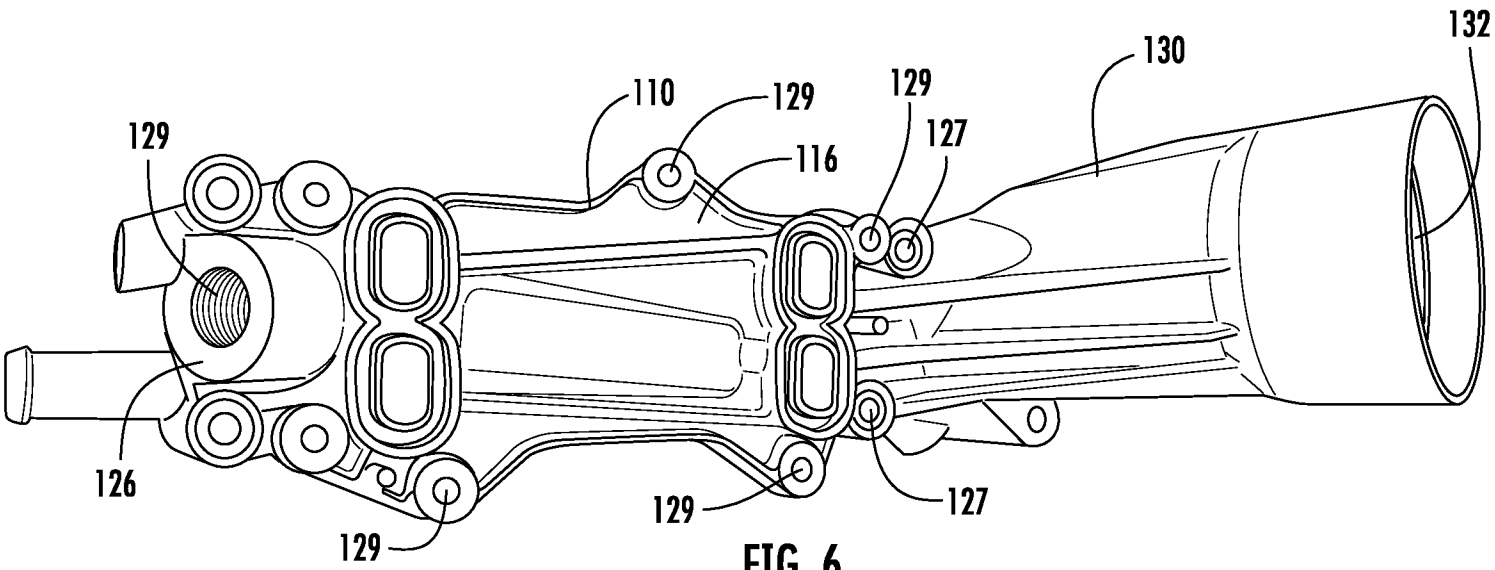

As shown in FIGS. 4 and 6, the adaptor 110, including the filter housing 130 and the base 120 outwardly appearance the same as the OEM part and the base accepts the OEM cooler 40 and the filter housing accepts the cap 32 without any modification.

What is claimed is:

1. An engine oil adaptor assembly for mounting in an engine valley, the adaptor comprising:

a unitary metallic casting that defines an integrated structure having:

an elongated casted body portion with a lower surface configured to mate with a predetermined existing engine;

an internal lubrication flow path formed within the elongated casted body that connects to a lubrication network within a valley in the predetermined existing engine and an oil filter housing defined at a first end of the elongated casted body; and, an upper surface of the elongated body is configured to mate with an oil cooler;

wherein the elongated casted body includes a plurality of apertures that are directly threaded in the elongated casted body for mating with a respective threaded component.

2. The engine oil assembly of claim 1 wherein the elongated cast metallic body includes a plurality of casted apertures that are directly threaded for receiving a respective threaded fastener to secure an oil cooler with the elongated cast metallic body.

3. An adaptor for an engine oil filtering assembly comprising:

a metallic casting having:

an elongated casted body portion with; a lower surface configured to mate with a lubrication network in an existing engine; an upper surface configured to mate with an oil cooler; an oil filter housing defined at a first end of the elongated body with an interior dimensioned to receive an oil filter; and, a wholly internal lubrication flow path that establishes a flow channel between the lubrication network and the oil filter housing;

wherein the elongated casted body includes at least one threaded passage in the casted body for mating with a respective threaded member.

4. An engine oil assembly comprising:

a one-piece metallic casting having: an elongated body portion with; a lower surface configured to mate with an existing engine lubrication network; an upper surface with an oil filter housing defined at a first end of the elongated body with an interior dimensioned to receive an oil filter; and, an oil flow path wholly within the elongated body portion that extends between the existing engine lubrication network and the filter housing;

wherein the elongated body of the one-piece metallic casting includes a plurality of threaded apertures that are threaded for mating with a respective threaded component.

5. An engine oil adaptor comprising:

an integral metallic casting that has:

an elongated body portion with a lower surface, an upper surface, first end, a second end, and an oil filter housing that is dimensioned to receive an oil filter therein;

the upper surface of the elongated body has the integrally cast oil filter housing at the first end of the elongated body and a portion of the upper surface between the oil filter housing and the second end is configured to receive an oil cooler;

the lower surface of the elongated body is configured to mate with a predetermined existing engine and has a wholly internal fluid flow path for establishing a fluid connection between the elongated body and a lubrication network within the predetermined existing engine;

wherein at least one casted aperture is provided at the first end or the second end of the elongated body and casted aperture in the elongated body is threaded and dimensioned to receive an additional component is a threaded connection with the elongated body.

6. An adaptor for connecting an oil filter and an oil cooler within an engine, the adaptor comprising:

a single metallic casting having:

an elongated body with a lower surface configured to mate with an oil lubrication network within an engine, an oil filter housing at a first end of the elongated body, and an upper surface of the elongated body is configured to mate with an oil cooler;

wherein the elongated body includes: an enclosed oil lubrication flow path that is wholly within the elongated body and the extends between an oil lubrication network within an engine, and the oil filter housing; and, at least one casted aperture is threaded directly in the single metallic casting for receiving at least one additional component in a direct threaded engagement with the single metallic casting.

* * * * *